US005768677A

United States Patent [19]

Natsume

[11] Patent Number: 5,768,677

[45] Date of Patent: Jun. 16, 1998

[54] IMAGE FORMING APPARATUS AND METHOD OF FORMING IMAGES AND PROCESSING SHEETS

[75] Inventor: Junko Natsume, Aichi-ken, Japan

[73] Assignee: Minolta Co., Ltd., Osaka, Japan

[21] Appl. No.: 803,631

[22] Filed: Feb. 21, 1997

[30] Foreign Application Priority Data

Feb. 22, 1996 [JP] Japan ..... 8-034932

[51] Int. Cl.[6] ..... G03G 15/00

[52] U.S. Cl. ..... 399/376; 399/81; 399/407

[58] Field of Search ..... 399/407, 376, 399/81, 86, 196, 197

[56] References Cited

U.S. PATENT DOCUMENTS 5,150,224 9/1992 Mitzude et al. ..... 399/196 X 5,237,379 8/1993 Sklut et al. ..... 399/86

5,311,259 5/1994 Moriya et al. ..... 399/86

5,321,486 6/1994 Nanbu et al. ..... 399/86 X

FOREIGN PATENT DOCUMENTS 5-238636 9/1993 Japan .

*Primary Examiner*—S. Lee

*Attorney, Agent, or Firm*—Burns, Doane, Swecker & Mathis, LLP

[57] ABSTRACT

An image forming apparatus for forming an image on a sheet based on an original image. The image forming apparatus includes a detecting device for detecting a size of the original, a setting device for setting a finish size of the sheet, a folding device for folding the sheet, and a control device for controlling the folding device based on the original size detected by the detecting device and the finish size set by the setting device.

23 Claims, 11 Drawing Sheets

IMAGE FORMING APPARATUS AND METHOD OF FORMING IMAGES AND PROCESSING SHEETS

BACKGROUND OF THE INVENTION

1. Field of the Invention

The present invention relates to an image forming apparatus such as a copying machine, a printer or the like for forming images on sheets such as record paper sheets based on an original image, and in particular to an image forming apparatus provided with sheet folding means for folding sheets having images, and also relates to a method of forming images on the sheets based on an original image and folding the sheets having the images, if necessary.

2. Description of the Related Art

Generally in image forming apparatuses such as a copying machine, a printer and others, a sheet such as a record paper sheet on which an image corresponding to an original image is formed through an image forming process is externally discharged onto a tray or the like without a further processing.

If the sheets having the images thus formed are large in size, or sheets of different sizes are to be handled, it is inconvenient to handle and store them. Therefore, the sheets are usually folded into sizes allowing easy handling and storing. If this folding is to be carried out manually, it requires considerable time and effort. Accordingly, there have been proposed various kinds of image forming apparatuses originally equipped with sheet folding devices, which are arranged, for example, subsequently to fixing devices for fixing toner images to the sheets, and can automatically fold the sheets.

For example, a sheet folding device taught by Japanese Laid-Open Patent Publication No. 5-238636 (238636/1993) operates as follows. When a sheet having a size different from a predetermined size is transported into the device, the manner of folding is changed in accordance with the size, and the sheet is always folded into a predetermined standard finish size for discharging the same.

According to the sheet folding device taught by Japanese Laid-Open Patent Publication No. 5-238636, the sheets are always folded into the standard finish size when folding the sheet is necessary. Although the standard finish size allows easy handling, it may be different from a finish size which is desirable for a user.

SUMMARY OF THE INVENTION

Accordingly, it is an object of the invention to provide an image forming apparatus for forming an image on a sheet based on an original image, and particularly an image forming apparatus which can fold sheets into finish sizes desired by a user.

Another object of the invention is to provide an image forming apparatus for forming an image on a sheet based on an original image, and particularly an image forming apparatus which can form an image on a sheet of an appropriate size and fold or finish the sheet into a finish size desired by a user.

Still another object of the invention is to provide a method of forming an image and processing a sheet, in which an image is formed on a sheet based on an original image, and the sheet having the image is finished to have a predetermined finish size, and particularly a method of forming an image and processing a sheet, which can finish the sheet to have a size desired by a user.

Yet another object of the invention is to provide a method of forming an image and processing a sheet, in which an image is formed on a sheet based on an original image, and the sheet having the image is finished into a predetermined finish size, and particularly a method of forming an image and processing a sheet, in which an image is formed on a sheet of an appropriate size, and the sheet having the image is finished into a finish size desired by a user.

The invention provides image forming apparatuses of the following two types (1) and (2).

(1) An image forming apparatus (image forming apparatus of the first type) for forming an image on a sheet based on an original image, including detecting means for detecting a size of the original, setting means for setting a finish size of the sheet, folding means for folding the sheet, and control means for controlling the folding means based on the original size detected by the detecting means and the finish size set by the setting means.

(2) An image forming apparatus (image forming apparatus of the second type) for forming an image on a sheet based on an original image, including detecting means for detecting a size of the original, finish size entering means for entering a finish size of the sheet, folding means for folding the sheet, and control means for determining a size of the sheet for image formation and an image formation magnification based on the original size detected by the detecting means and the finish size entered by the finish size entering means, and controlling the folding means based on the entered finish size and the determined sheet size.

The image forming apparatus may be, for example, an electrophotographic analog copying machine, a digital copying machine, a printer or the like.

In either of the image forming apparatuses of the first and second types, the sheet after image formation can be finished into the set or entered finish size. The "finish size" is the size of the folded sheet if the folding is performed, and is the actual size of the unfolded sheet if the folding is not performed. In either case, the finish size is the size of the sheet which a user can finally obtain. The same is true with respect to the "finish size" in a method of image forming and sheet processing according to the invention which will be described later.

In the image forming apparatus of the first type, the sheet on which the image is formed based on the original image is folded, if necessary, by the folding means based on the detected original size and the set finish size, so that the sheet has the finish size desired by the user finally.

In the image forming apparatus of the second type, the size of the sheet on which the image is to be formed, as well as the image formation magnification are determined based on the detected original size and the entered finish size, and the image formation is effected on the sheet of the determined size based on the original image with the determined image formation magnification. The folding means folds the sheet, if necessary, in accordance with the entered finish size and the determined sheet size, so that the sheet has the finish size desired by the user.

The invention also provides a method of forming an image on a sheet based on an original image and setting the sheet having the image into a predetermined finish size, comprising the steps of detecting the size of the original, setting the finish size of the sheet, forming the image on the sheet, and finishing the sheet into the finish size based on the detected original size and the set finish size.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
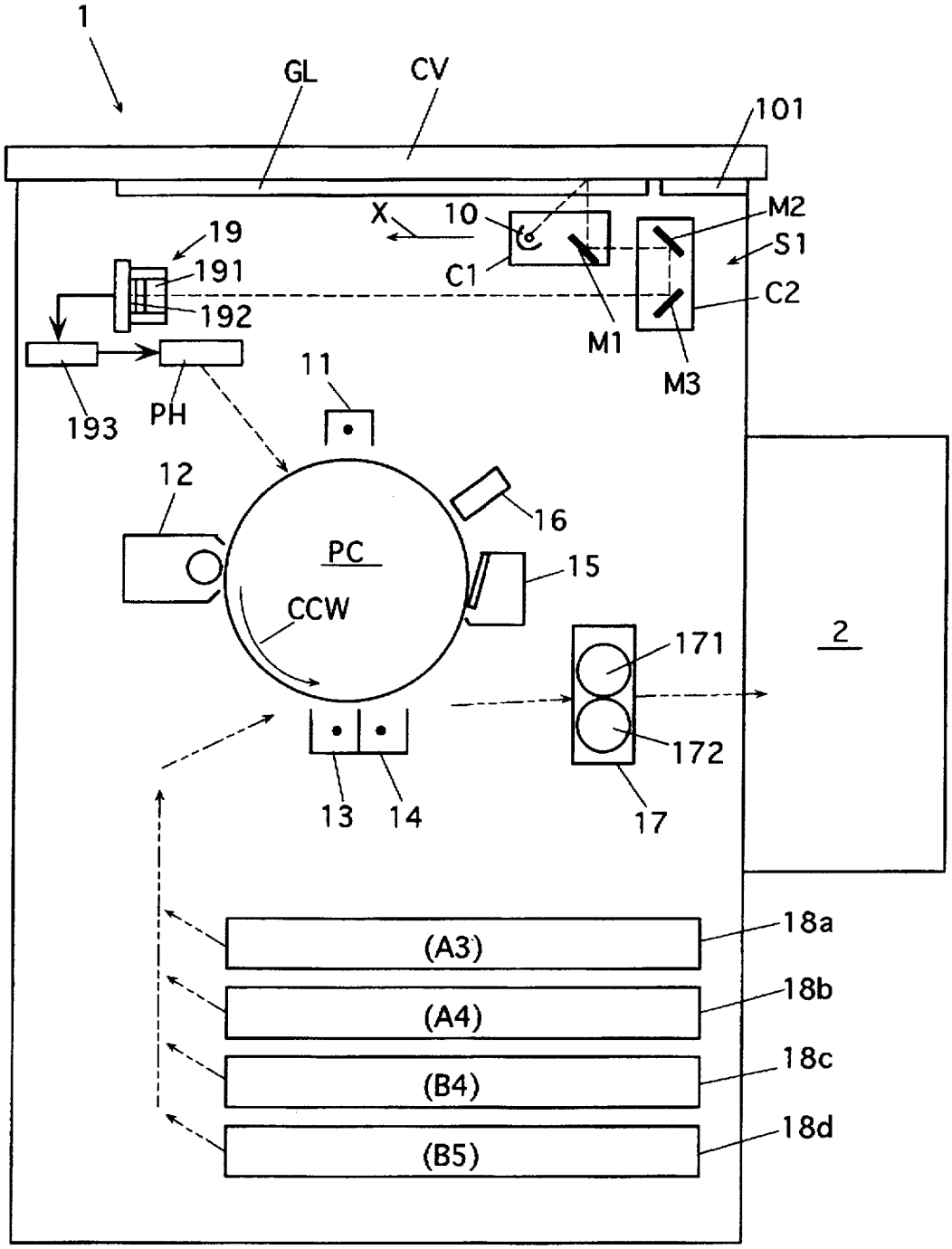
FIG. 1 schematically shows a structure of a digital copying machine equipped with a paper sheet folding device according to the invention.

The image forming apparatus of the above first type will be described below more in detail.

The original size detecting means may be a plurality of sensors arranged at the image forming apparatus, key entry means such as a operation key panel arranged at the image forming apparatus for entry of sizes of the originals, or a host equipment such as a computer connected to the image forming apparatus for entry of the original sizes. If the image forming apparatus is a digital copying machine, the detecting means may be operable to detect the original sizes based on the original image data read by image reading means which includes an image sensor such as CCD elements. The same is true with respect to the original size detecting means in the image forming apparatus of the second type.

The finish size setting means may be key entry means such as a operation key panel arranged at the image forming apparatus for setting the finish size, or a host equipment such as a computer connected to the image forming apparatus for entry of the finish size. The same is true with respect to the finish size entering means in the image forming apparatus of the second type.

The image forming apparatus of the first type may include selecting means for selecting a size of the sheet based on the original size detected by the detecting means and the finish size set by the setting means.

In this case, for example, the selecting means selects the sheet of the same size as the finish size when the original size detected by the detecting means is equal to or smaller than the finish size set by the setting means. When the original size detected by the detecting means is larger than the finish size set by the setting means, the selecting means selects the sheet of the size larger than the finish size. The control means may be operable to control the folding means in such a manner that the sheet is folded into the finish size when the selected size of the sheet is larger than the finish size. When the size of the sheet selected by the selecting means is equal to the finish size set by the setting means, the sheet which is not folded has the size equal to the finish size, so that the control means controls the folding means not to fold the sheet.

Further, the selecting means may select the sheet of double (twice as large as) the finish size, when the original size detected by the detecting means is larger than the finish size set by the setting means. For example, when the original size is the generally used A3 size, and the set finish size is A4 size allowing each handling, the selecting means selects the A3 sheet double the finish size, i.e., double the A4 sheet. In this example, the sheet is folded to divide the longer side of the A3 sheet into two, so that the finish size can be A4 size.

The image forming apparatus of the first type may further include magnification setting means for setting a magnification of the image formation on the sheet based on the original size detected by the detecting means and the finish size set by the setting means. In this case, an image corresponding to the original image is formed on the sheet of the selected size in the set magnification.

For example, the magnification setting means sets the magnification to 1 (100%) when the original size detected by the detecting means is equal to or smaller than the finish size set by the setting means, and sets the magnification to a value (selected sheet size)/(original size) obtained by dividing the size of the sheet selected by the selecting means by the original size, when the original size detected by the detecting means is larger than the finish size set by the setting means.

The magnification setting means may set the magnification to 1 (100%) when the original size detected by the detecting means is equal to or smaller than the finish size set by the setting means, or when the original size detected by the detecting means is larger than the finish size set by the setting means and is equal to or smaller than the size of the sheet selected by the selecting means. The magnification setting means may set the magnification to a value (selected sheet size)/(original size) obtained by dividing the size of the sheet selected by the selecting means by the original size, when the original size detected by the detecting means is larger than the finish size set by the setting means and is larger than the size of the sheet selected by the selecting means.

The image forming apparatus of the above second type will be described below more in detail.

The control means in the image forming apparatus of the second type may control the folding means to finish the sheet into the finish size as follows. When the original size detected by the detecting means is equal to or smaller than the finish size entered by the finish size entering means, the sheet of the same size as the finish size is selected, and the image formation magnification is set to 1 (100%). When the original size detected by the detecting means is larger than the finish size entered by the finish size entering means, the sheet of the size larger than the finish size is selected, and the image formation magnification is set to a value (selected sheet size)/(original size) obtained by dividing the selected size of the sheet by the original size, and the selected sheet is finally folded into the finish size.

The method of image formation and sheet processing according to the invention will be described below.

The method of image formation and sheet processing may further include the step of selecting the size of the sheet for image formation based on the detected original size and the set finish size.

In this case, for example, the sheet of the same size as the finish size is selected when the detected original size is equal to or smaller than the set finish size. When the detected original size is larger than the set finish size, the sheet of the size larger than the finish size is selected. When the selected size of the sheet is larger than the finish size, the sheet is folded into the finish size. When the selected size of the sheet is equal to the set finish size, the sheet which is not folded has the same size as the finish size, so that it is not necessary to fold the sheet. More specifically, when the detected original size is, for example, larger than the set finish size, the sheet of double (twice as large as) the finish size may be selected.

A magnification of image formation on the sheet may be set based on the detected original size and the set finish size, and the image may be formed on the sheet with the image formation magnification thus set.

In this case, when the detected original size is equal to or smaller than the set finish size, the magnification may be set to 1 (100%). When the detected original size is larger than the set finish size, the magnification may be set to a value (selected sheet size)/(original size)) obtained by dividing the size of the selected sheet by the original size.

The magnification may be set to 1 (100%) when the detected original size is equal to or smaller than the set finish size, or when the detected original size is larger than the set finish size, and the original size is equal to or smaller than the selected size of the sheet. When the detected original size is larger than the set finish size, and the original size is larger than the selected size of the sheet, the magnification is set to a value (selected sheet size)/(original size) obtained by dividing the selected size of the sheet by the original size.

Preferred embodiments of the invention will be described below with reference to the drawings.

FIG. 1 schematically shows a structure of a digital copying machine equipped with a sheet folding device according to the invention. This copying machine can finish copy sheets (record sheets of paper) into desired sizes (forms), in which the sheets are folded, if necessary, into a desired size of A4 or B5 (both in portrait orientation) convenient to handling.

In the following description, the "finish size" is the size of the copy sheet in the folded form, when the sheet is to be folded by the sheet folding device. When the copy sheet is not to be folded by the sheet folding device, the "finish size" is the same as the actual size of the copy sheet. In either case, the finish size is equal to the size of the copy sheet to be finally obtained by a user after the sheet is passed through the sheet folding device.

The original or original document of A4 in landscape orientation (A4 landscape) means such an original that has a size of A4, and is to be scanned with its longitudinal (longer) side parallel to a secondary scanning (subscanning) direction when the original image is scanned or read. The same is true with respect to the originals of A3, B4 and B5 sizes all in landscape orientation.

The original of A4 in portrait orientation (A4 portrait) means such an original that has a size of A4, and is to be scanned with its longitudinal or longer side perpendicular to a secondary scanning (subscanning) direction when the original image is scanned or read. The same is true with respect to the originals of A3, B4 and B5 sizes all in portrait orientation.

The copy sheet of A4 in landscape orientation (A4 landscape) means such a copy sheet that has a size of A4, and is transported with its longitudinal or longer side parallel to a transporting direction in the copying machine. The same is true with respect to the originals of A3, B4 and B5 sizes all in landscape orientation.

The copy sheet of A4 in portrait orientation (A4 portrait) means such a copy sheet that has a size of A4, and is transported with its longitudinal or longer side perpendicular to a transporting direction in the copying machine. The same is true with respect to the originals of A3, B4 and B5 sizes all in portrait orientation.

A structure of the digital copying machine 1 will be described below.

This copying machine includes an optical scanning system S1 which scans an image on an original document laid on an original platen glass GL, and also includes a photosensitive drum PC, around which a charger 11, a developing unit 12, a transfer charger 13, a separating charger 14, a cleaner 15 and an eraser 16 are arranged.

The optical scanning system S1 includes an illumination lamp 10 for radiating light beams to the image on the original laid on the original platen glass GL, reflection mirrors M1, M2 and M3 for leading light beams reflected by the original to an image reading unit 19, the image reading unit 19, and a memory unit 193 for storing the read image data. The illumination lamp 10 and the reflection mirror M1 are carried by a carriage C1, and the reflection mirrors M2 and M3 are carried by a carriage C2. Image reading unit 19 includes an image sensor 192 formed of CCD elements, and a lens 191 for focusing the image light beams, lead by the reflection mirror M3, onto the image sensor 192. This optical scanning system S1 can scan the image on the original of up to A3 size in landscape orientation.

As exposure means, the system includes a print head PH, which includes a light source formed of a semiconductor laser unit and can form an electrostatic latent image on the photosensitive drum PC based on image data stored in the memory unit 193.

Under the photosensitive drum PC, there are arranged sheet cassettes 18*a*, 18*b*, 18*c* and 18*d*, which accommodate copy sheets of A3, A4, B4 and B5 sizes to be supplied to a transfer position on the photosensitive drum PC, respectively. The copy sheets of these sizes accommodated in the sheet cassettes are in such orientations that the substantially same copied images as the original images can be obtained from the originals laid on the original platen glass GL in A3-landscape, A4-portrait, B4-landscape and B5-portrait orientations, respectively. In this copying machine 1, for example, the original of A4 laid on the original platen glass GL in landscape orientation is processed as the original of A3 in landscape orientation, and the original of B5 laid in landscape orientation is processed as the original of B4 in landscape orientation.

Although not shown, the copying machine includes a transporting system for copy sheets. The transporting system can transport a copy sheet, which is accommodated in one of the sheet cassettes 18*a*, 18*b*, 18*c* and 18*d*, to the transfer position on the photosensitive drum PC. Also, the transporting system can transport the copy sheet separated from the photosensitive drum PC to a fixing device 17, and can transport the copy sheet to a sheet folding device 2 from the fixing device 17. Chain lines with arrows in FIG. 1 show a sheet transport path.

Figure 2:
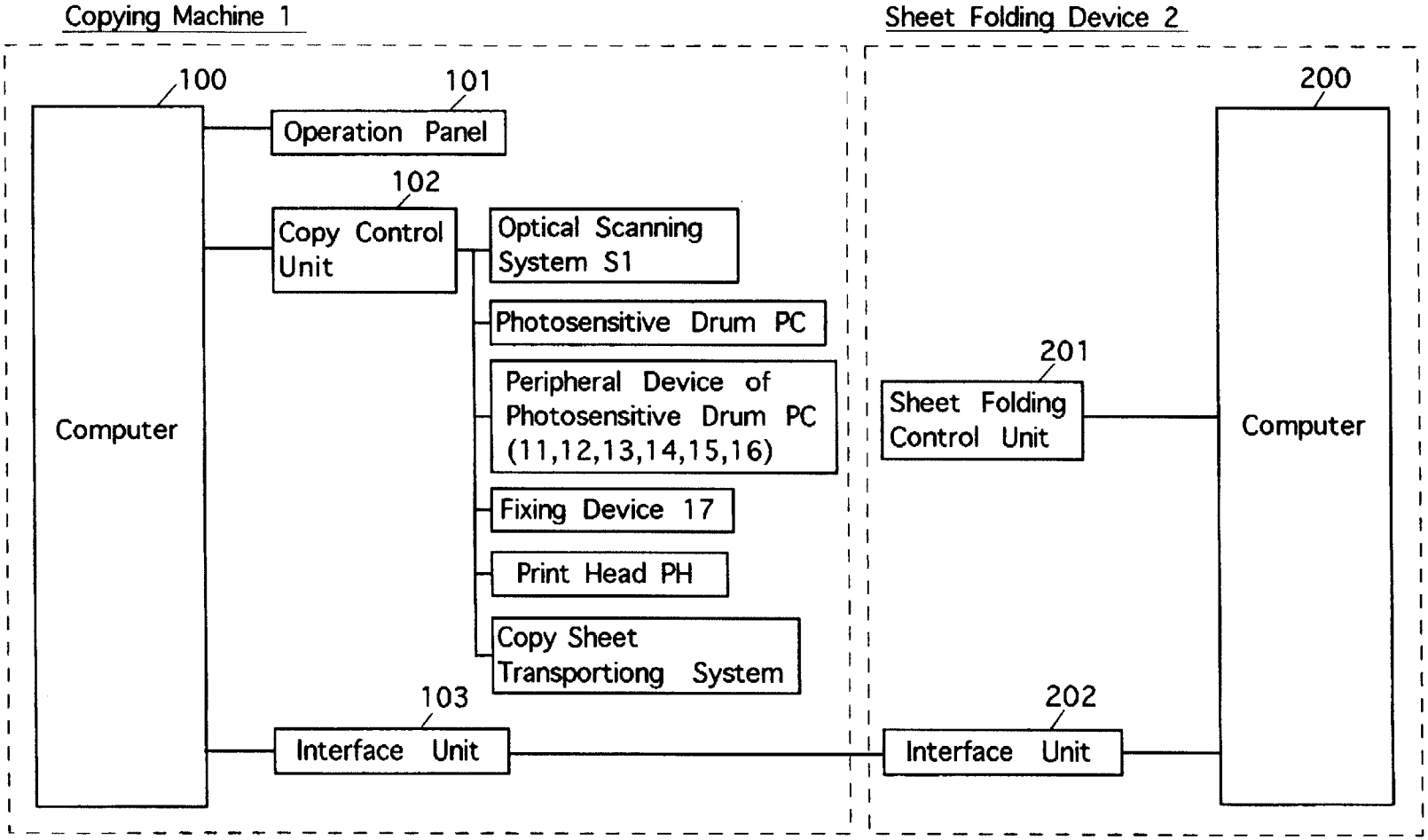
FIG. 2 is a schematic control block diagram of the copying machine shown in FIG. 1.

The optical scanning system S1, the photosensitive drum PC and peripheral devices of the photosensitive drum PC, copy sheet transporting system and others described above are connected to a copy control unit 102 as shown in FIG. 2, and are operated under control by the copy control unit 102. The copy control unit 102 is connected to a computer 100 including read-only memories (not shown) and random-access memories (not shown), and controls the foregoing devices and units in accordance with instructions from the computer 100.

The copying machine 1 has an operation panel 101 at its top. The operation panel 101 has a start key, a folding mode set key, a finish size set key, a numeric key and others, which are used for instruction of start of copying, setting of sheet folding mode (Z-folding mode, V-folding mode or non-folding mode), setting of finish size (A4 in portrait orientation or B5 in portrait orientation), setting of lumber of sheets to be copied and others, respectively. The operation panel 101 is also connected to the computer 100.

The copying machine 1 is also provided at its top with an openable document cover CV. The cover CV may be replaced with an automatic document feeder which also serves as the document cover.

Figure 12:
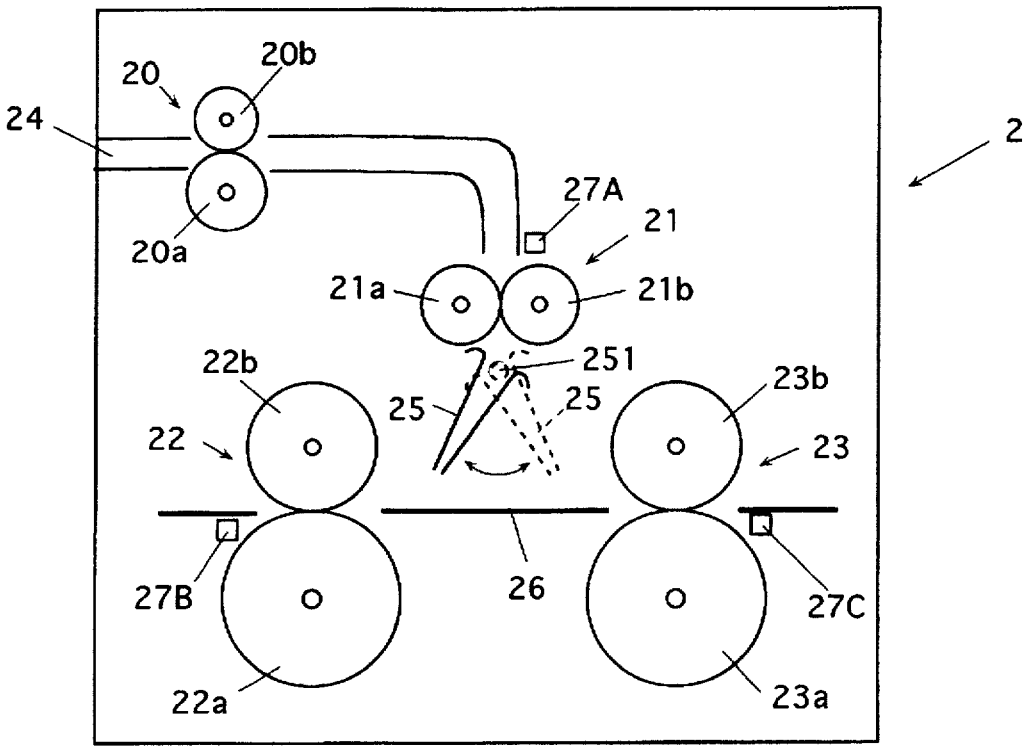
FIG. 12 schematically shows a structure of the sheet folding device shown in FIG. 1.

The sheet folding device 2 will be described below with reference to FIG. 12. FIG. 12 shows a schematic structure of the sheet folding device 2. The sheet folding device itself is well known (see Japanese Laid-Open Patent Publication No. 5-238636).

The copy sheet transported by the copy sheet transporting system in the copying machine 1 is supplied into the sheet folding device 2 through its entry 24. Near the entry 24, there is arranged a register roller pair 20 formed of a drive roller 20*a* and a pinch roller 20*b*, which can transport the copy sheet supplied thereto to a feed roller pair 21 formed of a drive roller 21*a* and a pinch roller 21*b*.

Under the feed roller pair 21, there are arranged first and second folding roller pairs 22 and 23, which are opposed to each other in the lateral direction in the figure. The first roller pair 22 is formed of a drive roller 22*a* and a pinch roller 22*b*. The second roller pair 23 is formed of a drive roller 23*a* and a pinch roller 23*b*.

A sheet guide member 25, which is pivotable or swingable substantially laterally in the figure around an axis 251, is disposed between the first and second roller pairs 22 and 23. Owing to this swing, the copy sheet supplied from the feed roller pair 21 can be selectively guided along a sheet guide plate 26 to the first roller pair 22 or the second roller pair 23.

A sheet detecting sensor 27A is arranged near and upstream to the feed roller pair 21 for detecting arrival of the copy sheet at the feed roller pair 21. Sheet detecting sensors 27B and 27C are arranged near and outside the first and second roller pairs 22 and 23 for detecting nipping of the copy sheets by the roller pairs 22 and 23, respectively.

This sheet folding device 2 is also provided with a computer 200 including read-only memories (not shown) and random-access memories (not shown) for instructing operation control as shown in FIG. 2. The computer 200 is connected to the computer 100 for controlling and instructing the operation of the copying machine 1 through interface units 202 and 103, and is operable to perform sheet folding in synchronization with the copying machine 1 and in accordance with a sheet folding mode which is already set through the operation panel 101. The computer 200 is connected to the sheet folding control unit 201, which can control operations of various units and parts in the sheet folding device 2 described above under the instructions by the computer 200.

Figure 3A:
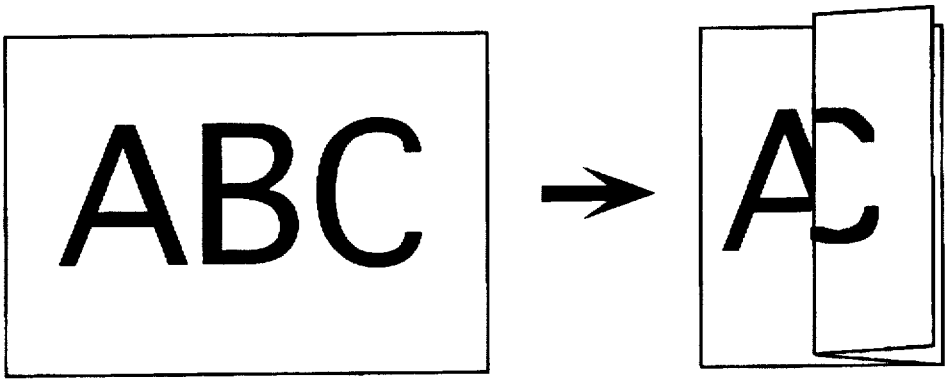
FIG. 3(A) shows Z-folding and FIG. 3(B) shows V-folding.
Figure 3B:
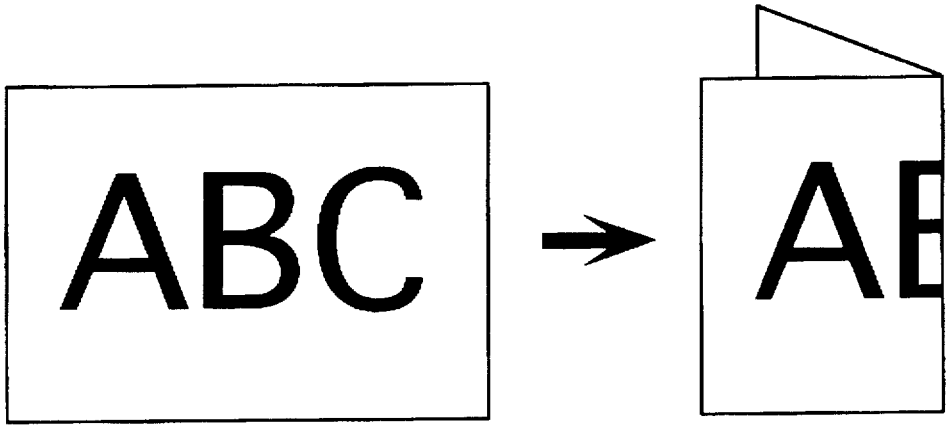

The sheet folding device 2 can fold the copy sheet, which has the copied image formed thereon and is transported from the copying machine 1, in accordance with the folding mode and the finish size where are already entered through the operation panel 101 of the copying machine 1 as described above. This sheet folding device 2 can selectively perform Z-folding or V-folding. The Z-folding is performed in such a manner that, as shown in FIG. 3(A), the sheet is first folded into halves with its image side inside, and one of the halves is further folded into halves with its image surface outside. The V-folding is performed in such a manner that, as shown in FIG. 3(B), the sheet is folded into halves with its image surface outside. Both the Z-folding and V-folding can provide the finish size which is half the original size before folding. Specific operations of the sheet folding device 2 will be described later.

Figure 4:
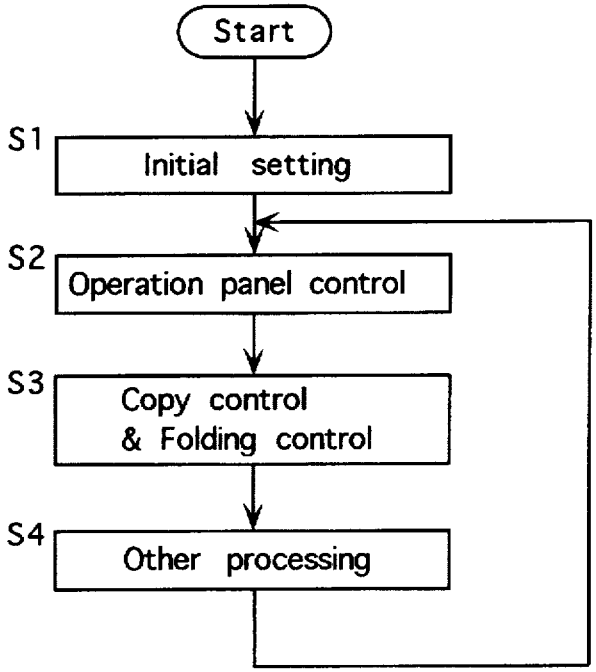
FIG. 4 is a flow chart of a main routine showing a processing by a control device which controls a copying machine equipped with the paper sheet folding device according to the invention.
Figure 5:
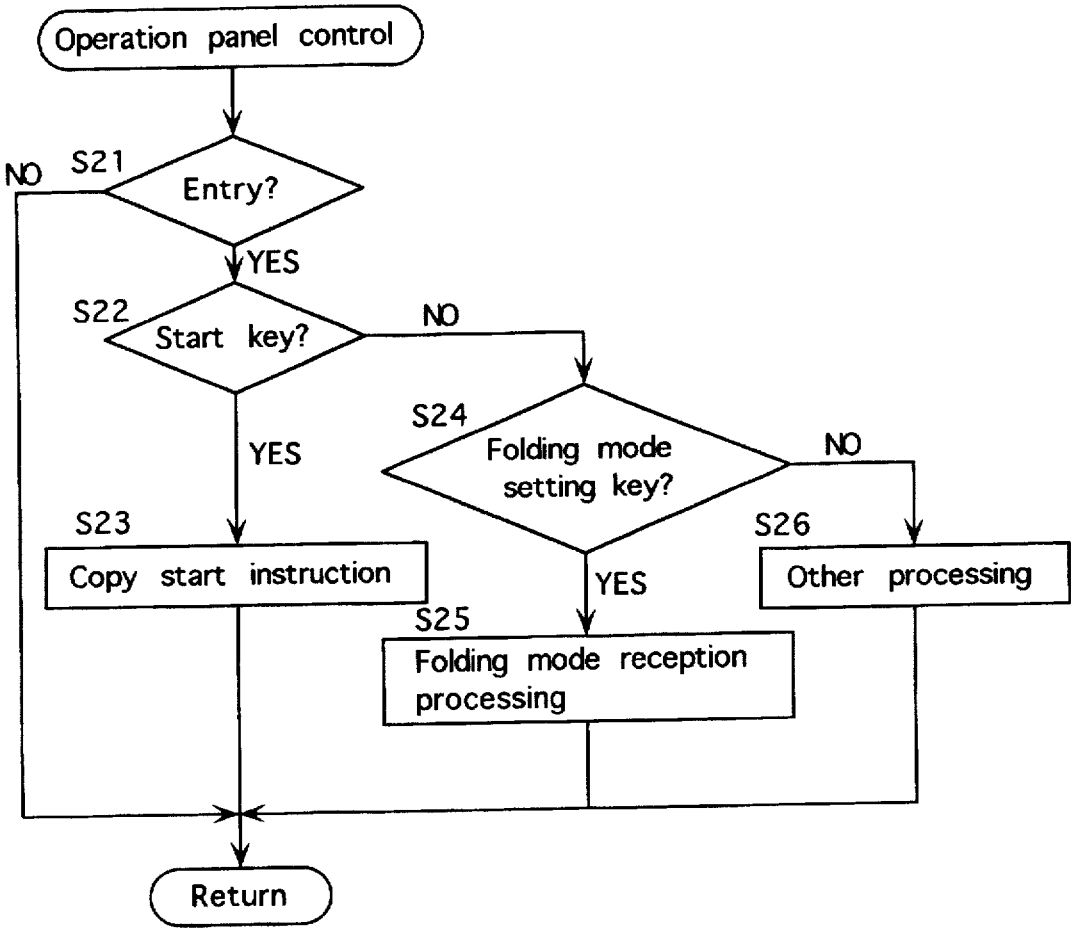
FIG. 5 is a flow chart showing operation panel control in FIG. 4.
Figure 6:
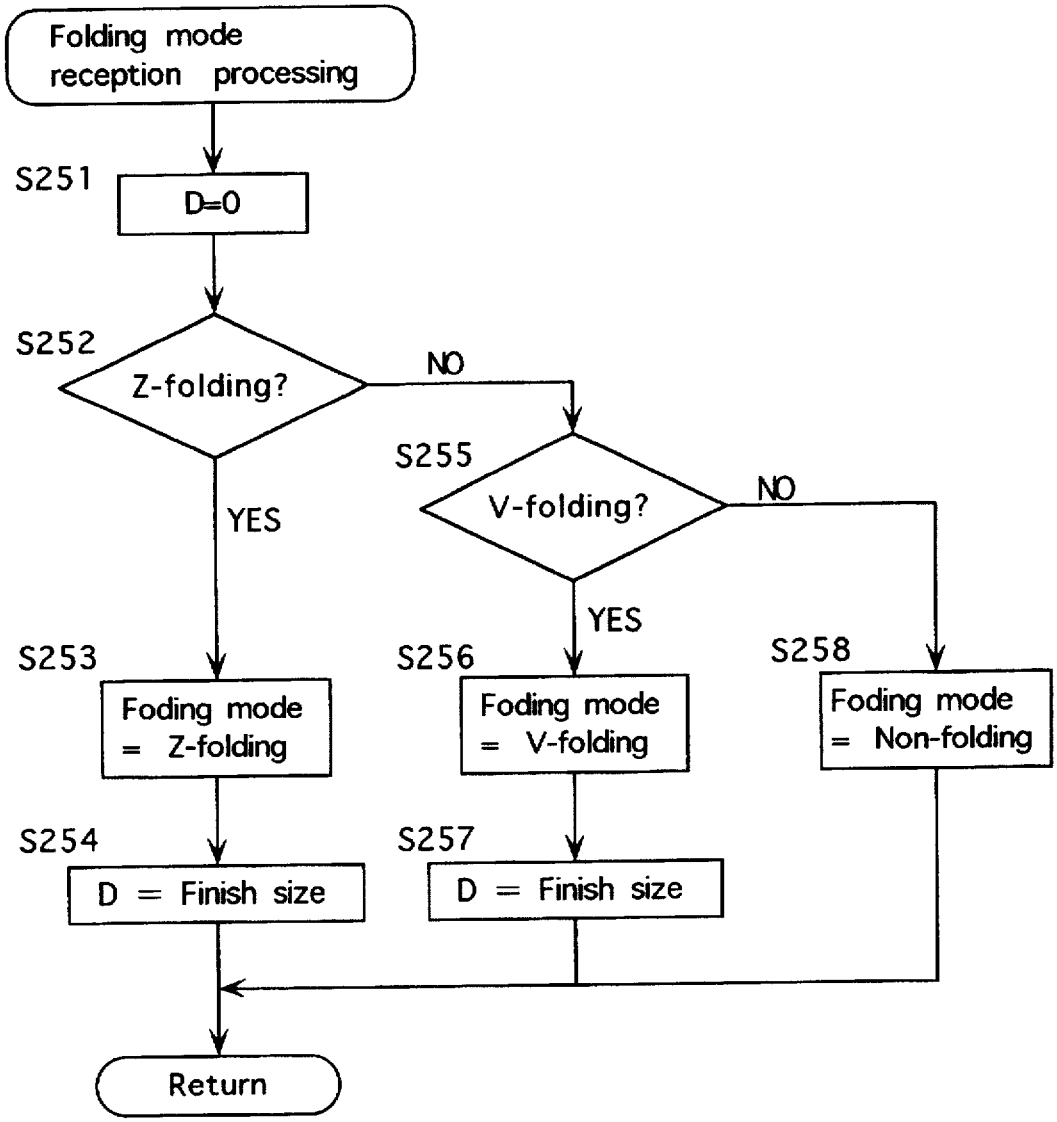
FIG. 6 is a flow chart showing sheet folding mode reception processing in FIG. 5.
Figure 7:
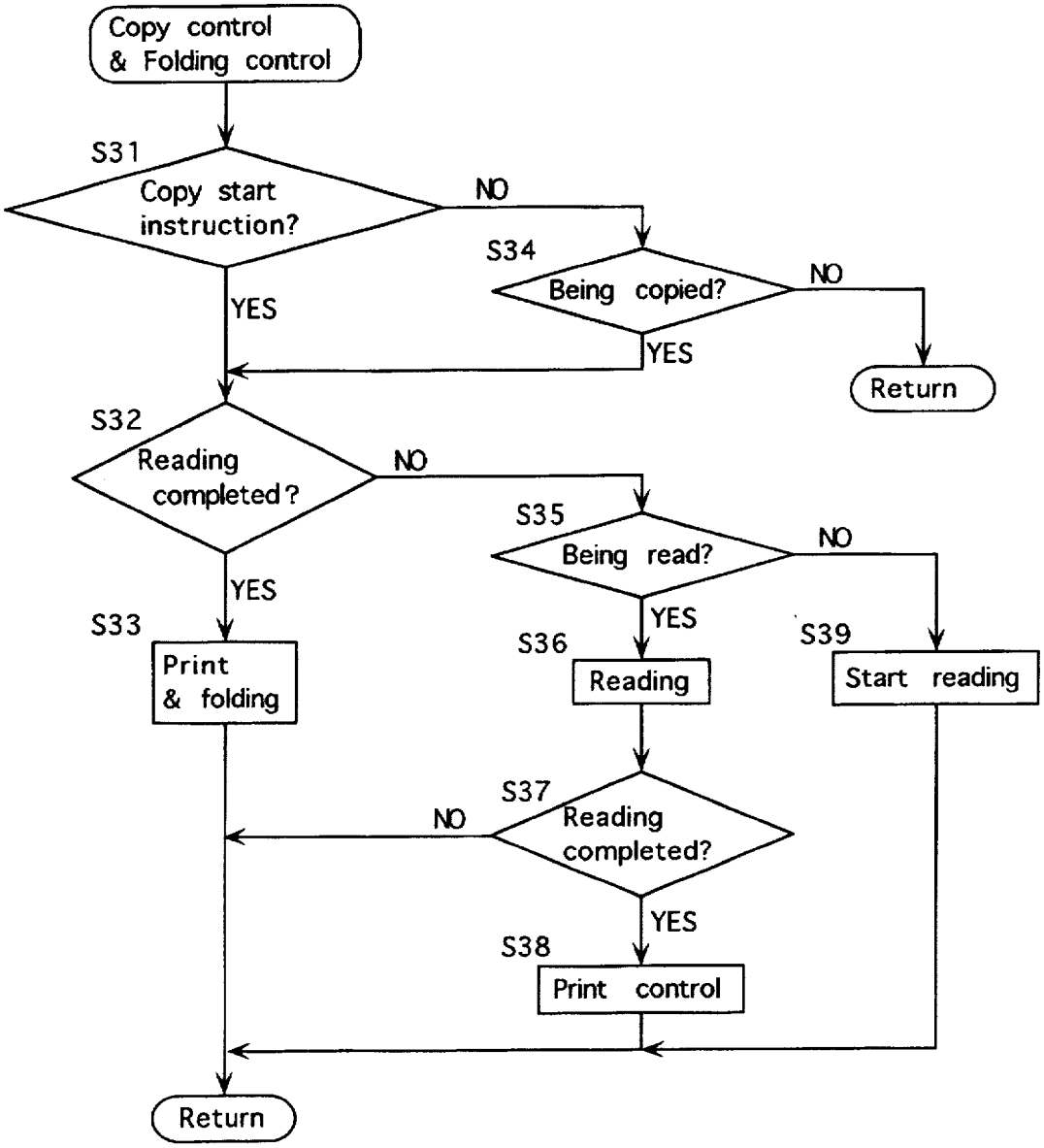
FIG. 7 is a flow chart showing copy control and sheet folding control in FIG. 4.
Figure 8:
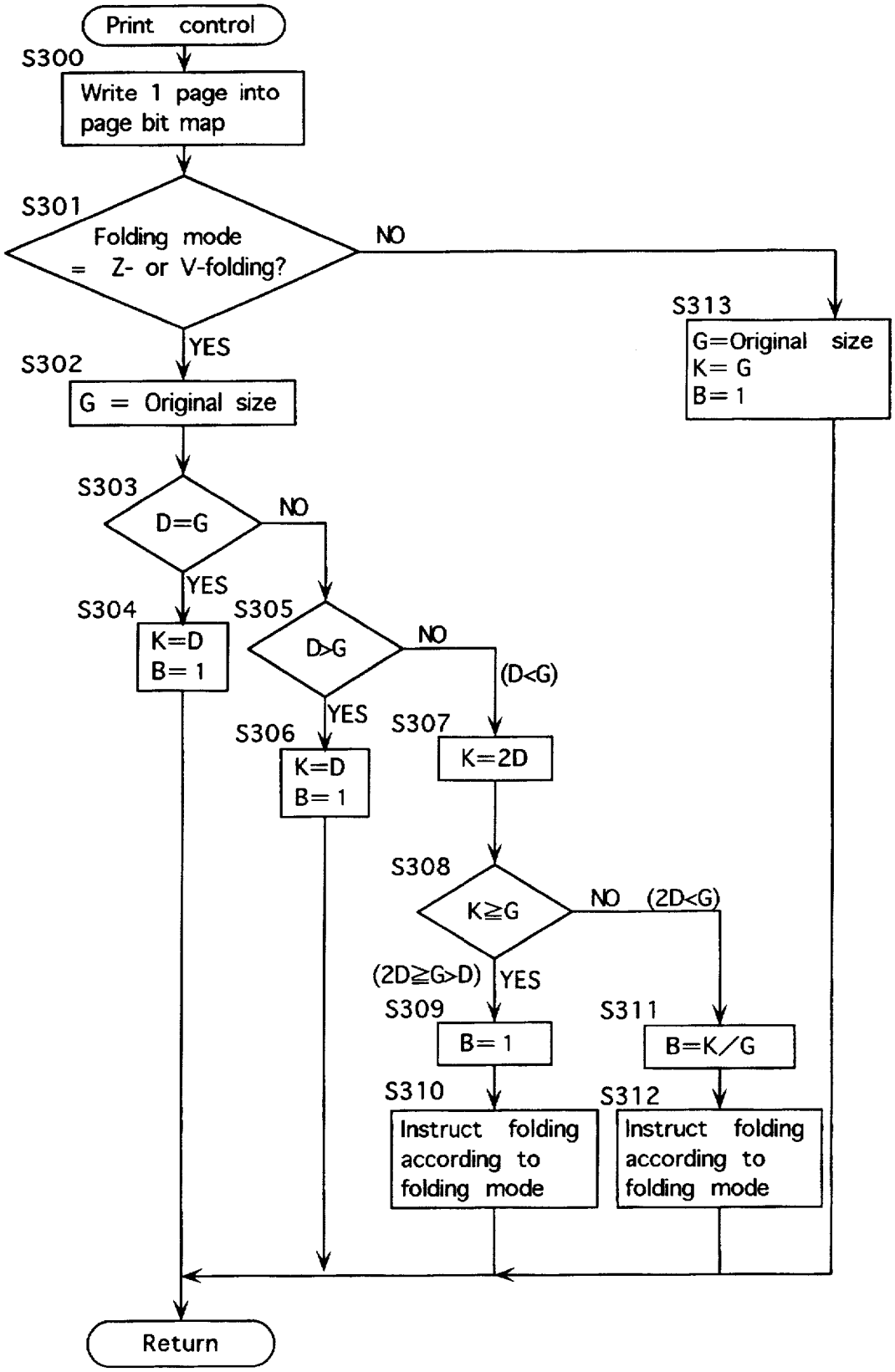
FIG. 8 is a flow chart showing print control in FIG. 7.

Operations of the copying machine 1 and the sheet folding device 2 will now be described below with reference to flow charts in FIGS. 4 to 8 showing contents of control by the computers 100 and 200. FIG. 4 is a flow chart showing a main routine. FIG. 5 is a flow chart showing operation panel control in FIG. 4. FIG. 6 is a flow chart showing folding mode reception processing in FIG. 5. FIG. 7 is a flow chart showing copy control and folding control in FIG. 4. FIG. 8 is a flow chart showing print control in FIG. 7. In the flow charts in FIGS. 4 to 8, D represents a control parameter showing a finish size, G represents a control parameter showing an original size, i.e., a size of an original document, K represents a control parameter showing a copy sheet size, and B represents a control parameter showing a copy magnification.

When the copying machine 1 and folding device 2 are powered on by pushing the power switch, the computers 100 and 200 perform initial operations such as initialization and initial setting of various parameters (step S1 in FIG. 4). When the initial setting is completed, operation panel control for key entry on the operation panel 101 (S2), copy control and folding control for copying and folding in accordance with the folding mode and others entered at the step S2 (S3), and other processing (S4) are successively repeated.

The operation panel control is performed as follows. As shown in FIG. 5, it is first determined whether key entry through the operation panel 101 is already performed or not (step S21 in FIG. 5). When the key entry is not performed (S21: NO), the processing returns to the main routine.

When the key entry is performed (S21: YES) particularly with the start key (S22: YES), the computer 100 issues an instruction for copy start (S23), and the processing returns. When the key entry with a key other than the start key is performed (S22: NO), it is determined whether it is performed with the folding mode setting key or not (S24).

When the key entry is performed with the folding mode setting key (S24: YES), reception of the sheet folding mode shown in FIG. 6 is performed (S25), and the processing returns. When it is performed with a key other than the folding mode setting key (S24: NO), key entry for setting the intended number of copied sheets and/or others is performed (S26), and the processing returns.

In the sheet folding mode reception processing, parameter D representing the finish size is preset to 0 (step S251 in FIG. 6), and it is determined whether the entered folding mode is the Z-folding or not (S252).

If it is the Z-folding (S252: YES), the sheet folding mode is set to the Z-folding (S253), and the intended finish size (A4 portrait or B5 portrait in this example), which is entered through the size setting key, is assigned to the parameter D (S254).

In the case other than Z-folding (S252: NO), it is determined whether the V-folding is entered or not (S255). If the V-folding is entered (S255: YES), the sheet folding mode is set to the V-folding (S256), and the finish size entered through the size setting key is assigned to the parameter D (S257). If the mode is other than the V-folding (S255: NO), the folding mode is set to the non-folding (S258).

In the sheet folding mode reception processing described above, the sheet folding mode is set to one of the Z-folding, V-folding and non-folding. When the sheet folding mode is Z-folding or V-folding, the finish size is set to A4 portrait or B5 portrait.

The copy control and the sheet folding control (step S3 in FIG. 4) will be described below with reference to FIG. 7.

First, it is determined whether or not the computer 100 issues the instruction for copy start (step S23 in FIG. 5) at the operation panel control (step S31 in FIG. 7). When the copy start instruction is not issued (S31: NO), and the copying is not being performed (S34: NO), the processing returns to the main routine.

When the copy start instruction is issued (S31: YES), or when the copying is being performed (S31: NO. S34: YES), it is then determined whether or not reading of an image by the optical scanning system S1 is completed (S32). The computer 100 stops issuing of the copy start instruction during copying after start of the copying.

When the image reading is not yet started (S32: NO, S35: NO), image reading starts (S39), and the processing returns to the main routine.

When the image reading is being performed (S32: NO, S35: YES), this reading will continue until completion thereof (S36). When reading of one original document is completed (S37: YES), print control is performed (S38), and the processing returns to the main routine. Although the contents of print control (S38) will be described later in detail, the original size, copy sheet size and copy magnification are determined, and an instruction for sheet folding is issued.

Upon completion of reading (S32: YES), printing is effected on the copy sheet of the size determined by the print control (S38) with the determined copy magnification, and the sheet folding device 2 folds the sheet based on the sheet folding instruction (S33).

The image reading and printing are performed by the following operations of respective units and parts in the copying machine 1 under the control by the copy control unit 102 in accordance with the instruction by the computer 100 (see FIG. 1).

In the image reading operation by the optical scanning system S1, the illumination lamp 10 carried by the carriage C1 is turned on, and the carriage C1 is driven in a secondary scanning direction X. In this operation, the speed of the carriage C1 corresponds to the copy magnification. The carriage C2 is driven at half the speed of the carriage C1 in the same direction at the same time. The image light beams reflected by the original are led to the focusing lens 191 of the reading unit 19 by the reflection mirrors M1, M2 and M3. The light beams passed through the lens 191 are read by the image sensor 192 for storage in the memory unit 193.

The print head PH radiates laser beams to the exposure position on the photosensitive drum PC based on the image data stored in the memory unit 193.

In this operation, the photosensitive drum PC is rotated at a predetermined speed in the direction indicated by an arrow CCW in FIG. 1, and the surface thereof is uniformly charged by the charger 11. An electrostatic latent image is formed on the charged photosensitive drum PC at the exposure position by laser beams radiated from the print head PH based on the original image data. This electrostatic latent image is developed by the developing unit 12 into a toner image, which is transferred onto the copy sheet by the transfer charger 13.

The copy sheet is supplied to the above transfer position from the sheet cassette (18*a*, 18*b*, 18*c* or 18*d*) accommodating copy sheets of the determined size by the unillustrated transporting system.

The copy sheet holding the toner image is separated from the photosensitive drum PC by the separating charger 14 and is transported to the fixing device 17. In the fixing device 17, the copy sheet holding the toner image passes between a heating roller 171 heated to a predetermined temperature and a pressure roller 172 pressed against the heating roller 171. During this, the toner image is fixed to the copy sheet by heat and pressure. The copy sheet having the fixed toner image is transported by an unillustrated transporting system to the sheet folding device 2 (see FIG. 12).

In the sheet folding device 2, the copy sheet thus transported is sent through the register roller pair 20 into the sheet guide member 25 by the feed roller pair 21. When the sheet guide member 25 swings leftward in FIG. 12, the sheet moves to the first roller pair 22. The first roller pair 22 rotates in the same (positive) direction as the second roller pair 23, and nips the copy sheet to send the same leftward in FIG. 12. When the sheet folding is not to be performed, the sheet is directly discharged. When the sheet folding is to be performed, the operation is performed as follows. When the leading edge of the copy sheet covers the sheet detecting sensor 27B, the sensor 27B detects the same. While the copy sheet covers the sensor 27B, the first roller pair 22 continues the positive rotation. When a predetermined time elapses from detection of the leading edge by the sensor 27B, the sheet guide member 25 swings rightward in FIG. 12, and simultaneously the first and second roller pairs 22 and 23 start reverse rotation.

The copy sheet is folded by the second roller pair 23 while it is being sent rightward. In the case of V-folding, the whole copy sheet is passed through the second roller pair. For Z-folding, the sheet guide member 25 is swung leftward when a predetermined time elapses after the sheet detecting sensor 27C detects the leading edge of the folded sheet similarly to the former case. At the same time, the first and second roller pairs 22 and 23 start the rotation in the opposite direction (i.e., positive rotation), and the first roller pair 22 further folds the sheet. In this manner, Z-folding is completed.

The copy sheet thus folded is discharged from the sheet folding device 2 by unillustrated transporting means.

As described above, the sheet folding device 2 can discharge the copy sheets after Z- or V-folding or without folding in accordance with the sheet folding mode to be described later as well as the finish size, original size and copy sheet size.

Print control which is a sub-routine of the copy control and sheet folding control shown in FIG. 7 will be described below with reference to FIG. 8.

Original image data for one page read by the optical scanning system S1 is written into the memory unit 193

(S300). Then, it is determined whether the sheet folding mode is the Z-folding mode or the V-folding mode (S301).

(1) The sheet folding mode is the Z- or V-folding mode (S301: YES)

The detected original size is assigned to the parameter G representing the original size (S302). Detection of the original size is performed based on the image data stored in the memory unit 193. Detection of the original size may be performed with a plurality of sensors instead of the above manner. These sensors may be arranged under the original platen glass GL to detect the original size based on combination of existence and absence of the original. The original size detected in this manner is A3 landscape, B4 landscape, A4 portrait or B5 portrait.

The parameter G representing the original size is compared with the parameter D representing the finish size set by the sheet folding mode reception processing (see FIG. 6). Thus, the finish size and the original size are compared with each other, and the copy sheet size and the copy magnification are determined in accordance with the relationship in magnitude between them.

Description will be given on a manner of determining the copy sheet size (parameter K) and the copy magnification (parameter B) in accordance with the relationship in magnitude between the finish size (parameter D) and the original size (parameter G).

(1-1) The finish size is equal to the original size (D=G). (S303: YES)

The copy sheet size is set to the finish size (S304). In this case, all the original size, copy sheet size and finish size are equal to each other.

A value of 1 is assigned to the parameter B representing the copy magnification (S304). Thus, the original image is copied to the copy sheet at a magnification of 1.

In this case, an instruction for sheet folding is not issued, and thus the copy sheet having the copied image is sent into the sheet folding device 2 and is discharged from the device without being folded.

(1-2) The finish size is larger than the original size (D>G). (S303: NO, S305: YES)

The copy sheet size is set to the finish size (S306).

A value of 1 is assigned to the parameter B representing the copy magnification (S306). Thus, the original image is copied onto the copy sheet with a magnification of 1.

In this case, an instruction for sheet folding is not issued similarly to the former case, and the copy sheet having the original image is sent into the sheet folding device 2 and is discharged from the device without being folded.

(1-3) The finish size is smaller than the original size (D<G) (S303: NO, S305: NO)

The copy sheet size is set to double the finish size (A4 portrait or B5 portrait in this example) (S307). For example, when the finish size is A4 portrait, the copy sheet size is A3 landscape. When the finish size is B5 portrait, the copy sheet size is B4 landscape. Thus, the copy sheet size which will be folded into the set finish size is selected.

The copy sheet size determined in this manner may be smaller than the original size. Therefore, a relationship in magnitude between the copy sheet size and the original size is then determined (S308), and the copy magnification is determined in accordance with the relationship in magnitude. This is because that the original image cannot be fully copied onto the copy sheet if the original image is copied at a magnification of 1 when the copy sheet size is smaller than the original size.

(1-3-1) The copy sheet size is equal to or larger than the original size (S308: YES).

A value of 1 is assigned to the parameter B representing the copy magnification (S313). Thus, the original image is copied to the copy sheet with a magnification of 1. In this operation, the copy sheet size is equal to or larger than the original sheet size, so that no problem arises in copying of the original image to the copy sheet with a magnification of 1.

In this case, an instruction for folding the sheet in accordance with the sheet folding mode is issued (S310). More specifically, when the sheet folding mode is Z-folding, an instruction is issued to Z-fold the copy sheet transported into the sheet folding device 2. When the sheet folding mode is V-folding, an instruction for V-folding is issued. Therefore, when the copied sheet having the copied original image is transported into the sheet folding device 2, Z-folding is performed when the sheet folding mode is Z-folding. Also, V-folding is performed when the sheet folding mode is V-folding. In this manner, the sheet is folded into the intended finish size set by a user through the operation panel 101, and then is discharged from the folding device 2.

(1-3-2) The copy sheet size is smaller than the original size (S308: NO).

The copy magnification is set to a value of (copy sheet size)/(original size) (S311). Thus, the original image is reduced with the magnification of (copy sheet size)/(original size) to copy onto the copy sheet.

In this case, an instruction for folding in accordance with the sheet folding mode is issued (S312). More specifically, an instruction is issued to Z-fold the copy sheet transported to the sheet folding device 2, when the sheet folding mode is Z-folding. When the sheet folding mode is V-folding, an instruction for V-folding is issued. Therefore, the copy sheet having the original image and transported to the sheet folding device 2 is Z-folded when the sheet folding mode is Z-folding, and is V-folded when the sheet folding mode is V-folding. In this manner, the sheet is folded into an intended finish size set by a user through the operation panel 101, and then is discharged from the folding device 2.

The copy sheet size and the copy magnification determined in the print control described above depended on the finish size (A4 portrait or B5 portrait in this example) and the original size (A3 landscape, B4 landscape, A4 portrait or B5 portrait in this example) are shown in the following table 1.

TABLE 1

| | Original Size G | | | |
|---|---|---|---|---|
| Finish Size D | B5 | A4 | B4 | A3 |
| B5 | K = B5<br>B = 1 | K = B4<br>B = 1 | K = B4<br>B = 1 | K = B4<br>B = K/G |
| A4 | K = A4<br>B = 1 | K = A4<br>B = 1 | K = A3<br>B = 1 | K = A3<br>B = 1 |

K: copy sheet size, B: copy magnification

When the finish size is smaller than the original size (S303: NO, S305: NO), the magnification can be 1 (B=1), without comparison in magnitude between the copy sheet size and the original size performed in step S308. In this case, the copy magnification can be equal to 1 regardless of the relationship in magnitude between the finish size and the original size.

Description will now be given on the case where the sheet folding mode is non-folding which means that the folding is not to be performed (S301).

(2) The sheet folding mode is non-folding mode (S301: NO).

In this case, the apparatus operates in the same manner as an apparatus without the sheet folding device. In this example, the copy sheet size is set to the detected original size, and the copy magnification is set to 1 (S313).

In this case, an instruction for sheet folding is not issued. Therefore, the copy sheet having the copied image is discharged from the sheet folding device 2 without being folded.

Figure 10:
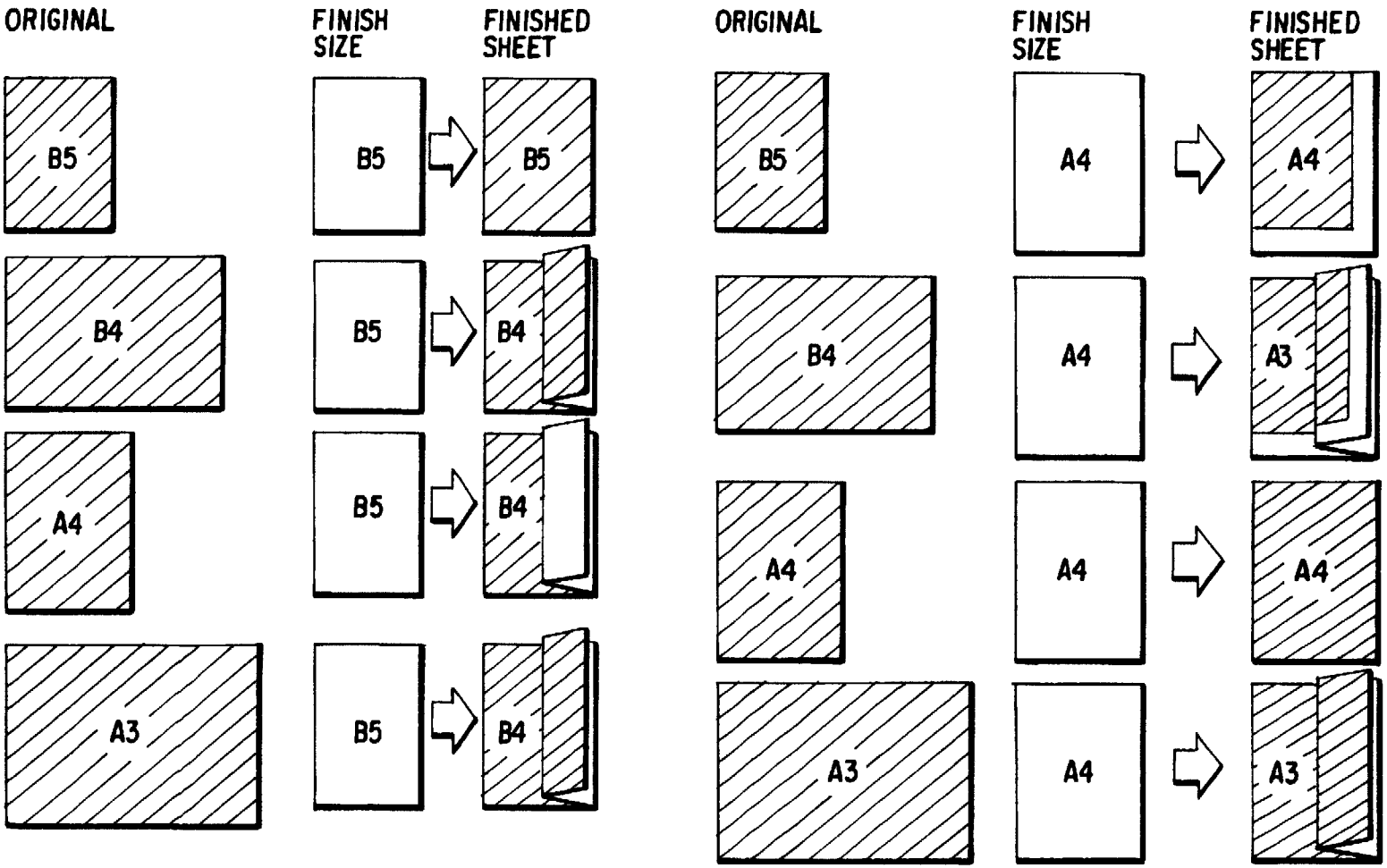
FIG. 10 shows an example of results of an experiment in which Z-folding is performed by copy control and sheet folding control in accordance with the flow chart in FIGS. 7 and 8.

FIG. 10 shows an example of results of an experiment, in which Z-folding was performed by the copying machine 1 equipped with the sheet folding device 2 described above. In FIG. 10, hatched portions represent the sizes of image. When the original size is A4 portrait and the finish size is B5, portrait, the original image is not entirely copied, in which case this situation may be displayed, e.g., on the operation panel to announce to the user.

According to the copy machine 1 equipped with the sheet folding device 2 of the invention, as described above, a user can set an intended finish size through the operation panel 101, and an appropriate size of the copy sheet (record sheet) and an appropriate copy magnification are selected in accordance with the finish size and original size. Thereby, the original image is copied to the copy sheet of the appropriate copy sheet size with the appropriate copy magnification, and the sheet folding device 2 can fold the sheet into the intended finish size. Even when the originals of different sizes are present, the original size detecting means can detect the original size, and thereby an appropriate copy sheet size and an appropriate copy magnification are selected similarly to the above case. Thus, the original image is copied to the copy sheet of the appropriate sheet size with the appropriate copy magnification, and the sheet folding device 2 can finish the sheet into the intended finish size.

Figure 9:
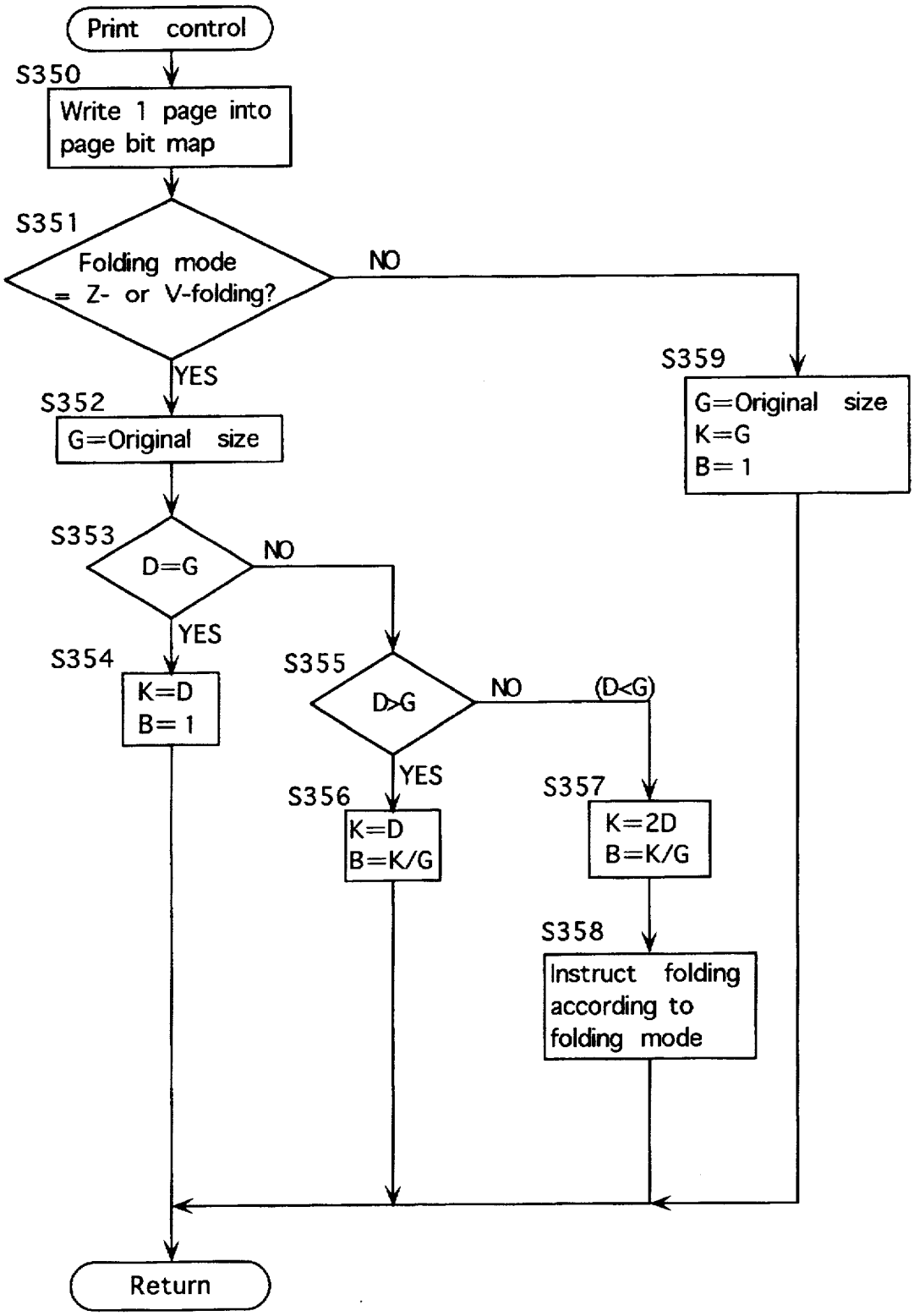
FIG. 9 is a flow chart showing another example of print control in FIG. 7.

The print control may be performed in accordance with the flow chart shown in FIG. 9 instead of the flow chart shown in FIG. 8 described above.

Description will be given on the processing different from that in the flow chart shown in FIG. 8, and specifically on the processing after comparing in magnitude between the finish size and the original size. Processings in steps S350–S352 in FIG. 9 are the same as those in the steps S300–S302 in FIG. 8. The processing performed in the non-folding mode (S351: NO, in FIG. 9), i.e., processing in a step S359 in FIG. 9 are the same as those in the step S313 in FIG. 8.

According to the flow chart in FIG. 9, the copy sheet size (parameter K) and the copy magnification (parameter B) are determined in accordance with the relationship in magnitude between the detected original size (parameter G) and the finish size (parameter D) set by a user, similarly to the case already described.

(A) The finish size is equal to the original size (D=G). (S353: YES)

The copy sheet size is set to the finish size (S354). In this case, all the original size, copy sheet size and finish size are equal to each other.

The copy magnification is set to 1 (S354). Thus, the original image is copied onto the copy sheet with a magnification of 1.

In this case, an instruction for sheet folding is riot issued. Therefore, the copy sheet having the copied image is discharged from the sheet folding device 2 without being folded.

(B) The finish size is larger than the original size (D>G). (S353: NO, S355: YES)

The copy sheet size is set to the finish size (S356).

The copy magnification is set to (copy sheet size)/(original size) (S356). Thus, the original image is enlarged at a magnification of (copy sheet size)/(original size) to copy onto the copy sheet.

In this case, an instruction for sheet folding is not issued, similarly to the above case. Therefore, the copy sheet having the copied image is discharged from the sheet folding device 2 without being folded.

(C) The finish size is smaller than the original size (D<G). (S353: NO, S355: NO)

The copy sheet size is set to double the finish size (A4 portrait or B5 portrait in this example) (S311). For example, when the finish size is A4, the copy sheet size is set to A3. When the finish size is B5, the copy sheet size is set to B4.

The copy magnification is set to (copy sheet size)/(original size) is selected (S357). Thus, the original image is enlarged or reduced at the magnification of (copy sheet size)/(original size), or is neither enlarged nor reduced, to copy onto the copy sheet.

In this case, an instruction for folding in accordance with the sheet folding mode is issued (S358). More specifically, when the sheet folding mode is Z-folding, an instruction is issued to Z-fold the copy sheet transported to the sheet folding device 2. When the sheet folding mode is V-folding, an instruction is issued to perform the V-folding Therefore, the copy sheet having the copied image and transported to the sheet folding device 2 is Z-folded when the sheet folding mode is Z-folding, or is V-folded when the sheet folding mode is V-folding. Thereby, the sheet is folded into the intended finish size set by the user through the operation panel 101 and is discharged from the folding device 2.

The copy sheet size and the copy magnification determined in the foregoing print control shown in FIG. 9 depended on the finish size (A4 portrait or B5 portrait in this example) and the original size (A3, B4, A4 or B5 in this example) are shown in the following table 2.

TABLE 2

| | Original Size G | | | |
|---|---|---|---|---|
| Finish Size D | B5 | A4 | B4 | A3 |
| B5 | K = B5<br>B = 1 | K = B4<br>B = K/G | K = B4<br>B = K/G | K = B4<br>B = K/G |
| A4 | K = A4<br>B = K/G | K = A4<br>B = 1 | K = A3<br>B = K/G | K = A3<br>B = K/G |

K: copy sheet size, B: copy magnification

Figure 11:
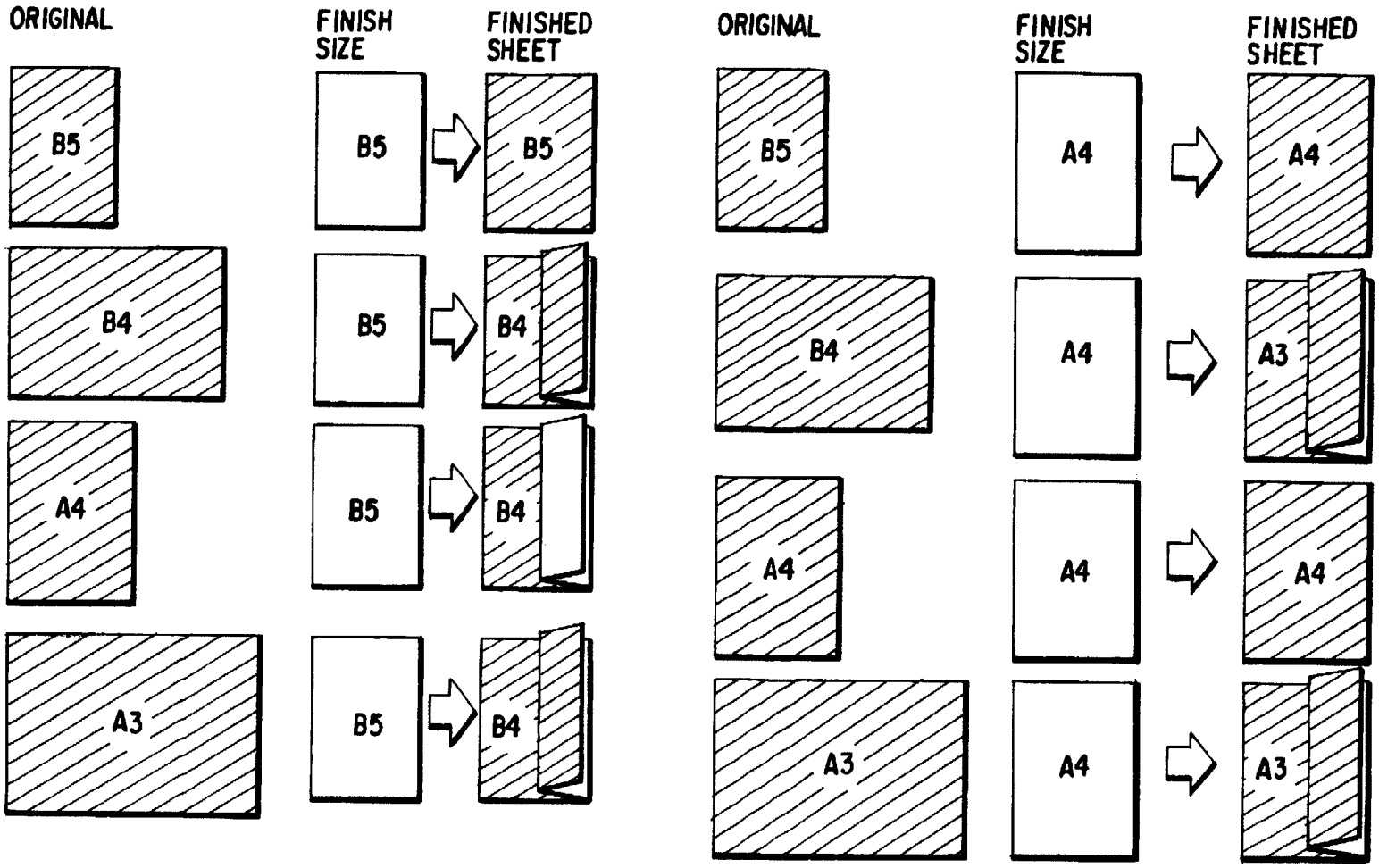
FIG. 11 shows results of an experiment of Z-folding performed by copy control and sheet folding control in accordance with the flow chart in FIGS. 7 and 9.

FIG. 11 shows an example of results of an experiment, in which the copy control and the sheet folding control were performed for Z-folding in accordance with the flow chart shown in FIG. 9. In FIG. 11, hatched portions represent the sizes of images. When the original size is A4 portrait and the finish size is B5 portrait, the original image is not entirely copied, in which case this situation may be displayed, e.g., on the operation panel.

According to the print control in accordance with the flow chart shown in FIG. 9, as described above, a user can set an intended finish size through the operation panel 101, and the copy sheet (record sheet) of an appropriate size and an appropriate copy magnification are selected depending on the finish size and the original size. Thereby, the original image is copied onto the copy sheet of the appropriate copy sheet size with the appropriate copy magnification, and the sheet folding device 2 can fold the sheet into the intended finish size. Even when originals of different sizes are present, the original size detecting means can detect the original size, so that an appropriate copy sheet size and an appropriate copy magnification are selected similarly to the above case. Thus, the original image is copied onto the copy sheet of the appropriate sheet size with the appropriate copy magnification, and the sheet folding device 2 can finish the sheet into the intended finish size.

Although the embodiment relating to the digital copying machine has been described as an example of the invention, the invention may be applied to image forming apparatuses such as an analog copying machine and a printer other than the digital copying machine.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus for forming an image onto a sheet based on an original, comprising:

detecting means for detecting a size of said original;

finish size setting means for setting a finish size of said sheet;

folding means for folding said sheet; and control means for controlling said folding means based on the original size detected by said detecting means and the finish size set by said finish size setting means.

2. The image forming apparatus according to claim 1, further comprising selecting means for selecting a size of said sheet based on the original size detected by said detecting means and the finish size set by said finish size setting means.

3. The image forming apparatus according to claim 2, wherein said selecting means selects a sheet of the same size as the finish size when the original size detected by said detecting means is equal to or smaller than the finish size, and selects a sheet of a size larger than the finish size, when the original size detected by said detecting means is larger than the finish size, and said control means controls said folding means in such a manner that the sheet selected by said selecting means is folded into the finish size when the size of the selected sheet is larger than the finish size.

4. The image forming apparatus according to claim 3, wherein said control means controls said folding means not to fold the sheet selected by said selecting means when the size of the selected sheet is equal to the finish size set by said finish size setting means.

5. The image forming apparatus according to claim 3, wherein said selecting means selects a sheet of a size twice as large as the finish size, when the original size detected by said detecting means is larger than the finish size.

6. The image forming apparatus according to claim 3, further comprising:

magnification setting means for setting a magnification of image formation on the sheet based on the original size detected by said detecting means and the finish size set by said finish size setting means.

7. The image forming apparatus according to claim 6, wherein said magnification setting means sets the magnification to 1 when the original size detected by said detecting means is equal to or smaller than the finish size set by said finish size setting means, and sets the magnification to a value obtained by dividing the size of the sheet selected by said selecting means by the original size detected by said detecting means, when the original size detected by said detecting means is larger than the finish size set by said finish size setting means.

8. The image forming apparatus according to claim 6, wherein said magnification setting means sets the magnification to 1 when the original size detected by said detecting means is equal to or smaller than the finish size set by said finish size setting means, said magnification setting means sets the magnification to 1 when the original size detected by said detecting means is larger than the finish size set by said finish size setting means and is equal to or smaller than the size of the sheet selected by said selecting means, and said magnification setting means sets the magnification to a value obtained by dividing the size of the sheet selected by said selecting means by the original size detected by said detecting means, when the original size detected by said detecting means is larger than the finish size set by said finish size setting means and is larger than the size of the sheet selected by said selecting means.

9. An image forming apparatus for forming an image onto a sheet based on an original, comprising:

detecting means for detecting a size of said original;

finish size entering means for entering a finish size of said sheet;

folding means for folding said sheet; and control means for determining a size of the sheet for image formation and an image formation magnification based on the original size detected by said detecting means and the finish size entered by said finish size entering means, and controlling said folding means based on the entered finish size and the determined sheet size.

10. The image forming apparatus according to claim 9, wherein said control means selects a sheet of the same size as the finish size and sets the image formation magnification to 1 when the original size detected by said detecting means is equal to or smaller than the finish size entered by said finish size entering means, and said control means selects a sheet of a size larger than the finish size entered by said finish size entering means, sets the image formation magnification to a value obtained by dividing the size of selected the sheet by the original size detected by said detecting means, and controls said folding means to fold the selected sheet into the finish size, when the original size detected by said detecting means is larger than the finish size.

11. A method of forming an image onto a sheet based on an original and finishing the sheet having the image formed thereon into a predetermined finish size, comprising the steps of:

detecting a size of the original;

setting a finish size of the sheet;

forming the image onto the sheet; and finishing the sheet into the finish size based on the detected original size and the set finish size with finishing means, the finishing means including means for folding the sheet into the finish size.

12. The method of image formation and sheet processing according to claim 11, further comprising the step of:

selecting a size of the sheet for image formation based on the detected original size and the set finish size.

13. The method of image formation and sheet processing according to claim 12, wherein a sheet of the same size as the finish size is selected when the detected original size is equal to or smaller than the set finish size, a sheet of a size larger than the finish size is selected when the detected original size is larger than the set finish size, and the selected sheet is folded into the finish size when the size of the selected sheet is larger than the finish size.

14. The method of image formation and sheet processing according to claim 13, wherein the selected sheet is not folded when the size of the selected sheet is equal to the set finish size.

15. The method of image formation and sheet processing according to claim 13, wherein a sheet of a size twice as large as the finish size is selected when the detected original size is larger than the set finish size.

16. The method of image formation and sheet processing according to claim 13, wherein a magnification of image formation on the sheet is set based on the detected original size and the set finish size, and the image is formed on the sheet with said set image formation magnification.

17. The method of image formation and sheet processing according to claim 16, wherein when the detected original size is equal to or smaller than the set finish size, the magnification is set to 1, and when the detected original size is larger than the set finish size, the magnification is set to a value obtained by dividing the size of the selected sheet by the original size.

18. The method of image formation and sheet processing according to claim 16, wherein when the detected original size is equal to or smaller than the set finish size, the magnification is set to 1, when the detected original size is larger than the set finish size, and the original size is equal to or smaller than the size of the selected sheet, the magnification is set to 1, and when the detected original size is larger than the set finish size, and the original size is larger than the size of the selected sheet, the magnification is set to a value obtained by dividing the size of the selected sheet by the original size.

19. The method of claim 11, wherein the finishing step includes folding the sheet into the finish size if the size of the original is greater than the finish size.

20. A method of forming an image onto a sheet, comprising the steps of:

detecting a size of an original;

setting a finish size of the sheet;

forming the image onto the sheet; and determining if the sheet needs to be folded by a finisher based on the detected original size and the set finish size.

21. The method of image formation according to claim 20, wherein the finish size is set manually.

22. The method of image formation according to claim 20, further comprising the step of selecting the size of the sheet for image formation based on the detected original size and the set finish size.

23. The method of image formation according to claim 22, wherein the sheet of the same size as the finish size is selected when the detected original size is equal to or smaller than the set finish size, the sheet of the size larger than the finish size is selected when the detected original size is larger than the set finish size, and the sheet is folded into the finish size when the selected size of the sheet is larger than the finish size.

* * * * *